United States Patent [19]

Fless

[11] 4,188,205

[45] Feb. 12, 1980

[54] FUEL INJECTION IN BLAST FURNACES

[75] Inventor: Donald E. Fless, Burlington, Canada

[73] Assignee: Alchem, Inc., Burlington, Canada

[21] Appl. No.: 883,772

[22] Filed: Mar. 6, 1978

[51] Int. Cl.[2] ..... C22B 5/00

[52] U.S. Cl. ..... 75/42

[58] Field of Search ..... 75/41, 42

[56] References Cited

U.S. PATENT DOCUMENTS 2,141,848 12/1938 Adams et al. ..... 44/68

FOREIGN PATENT DOCUMENTS 926130 5/1973 Canada ..... 75/42

*Primary Examiner*—M. J. Andrews

*Attorney, Agent, or Firm*—John G. Premo; Robert A. Miller

[57] ABSTRACT

This invention encompasses an improved process for injecting a homogenized water-hydrocarbon liquid fuel composition into blast furnace of the type wherein water and a liquid hydrocarbon fuel is homogenized and then atomized into a blast furnace under pressure to reduce coke consumption, the improvement which comprises introducing into the water-hydrocarbon liquid fuel composition usually prior to homogenization a metallic element in the form of a compound thereof, said metallic element being selected from the group consisting of magnesium, calcium, manganese, iron, cobalt, nickel, copper, zinc, aluminum, tin, lead, strontium, barium, zirconium, chromium, molybdenum, and tungsten in a quantity sufficient to provide 5–50 ppm as metal in the water-hydrocarbon liquid fuel composition whereby the efficiency of the blast furnace water-hydrocarbon liquid fuel injection is improved.

In addition, from 100–10,000 ppm of a water-in-oil emulsifying agent may be incorporated into the water-hydrocarbon liquid fuel composition.

12 Claims, No Drawings

FUEL INJECTION IN BLAST FURNACES

INTRODUCTION

The blast furnace method for the preparation of technical grade iron or pig iron from iron ore is based essentially on the reduction of iron oxide with carbon. The carbon employed is generally in the form of coke. Due to the cost and availability of coke, this material is oftentimes partially replaced by coke oven tar, hydrogen gas, coal, fuel oils, etc. It is noted that it is possible to blow coal, gases or liquid petroleum products into the furnace to promote indirect reduction, increase the blast furnace output, and decrease the consumption of coke, a material that is expensive to produce and desirable to replace. Many recent developments in blast furnace technology have been centered on methods to partially replace the expensive coke with cheaper oils or coke tar. However, with modern technology, coke can be replaced to only a given extent by a liquid fuel such as crude oil, coke tar, residual oil, or fuel oil. Modern technology, when introducing these materials into a blast furnace to reduce coke consumption, calls for these materials to be sprayed or atomized into the furnace. Unfortunately, procedures of this type often give rise to considerable soot formation which is both undesirable from a pollution standpoint and which also upsets the equilibrium of the blast furnace process.

In the blast furnace process, iron bearing materials including iron ore, sinter, mill scale, scrap, or other iron source along with a fuel, generally coke, and a flux, limestone, or dolomite are charged into the top of the furnace. Heated air, and in some instances, coal is blown in at the bottom. The blast furnace burns part of the fuel to produce heat for melting the iron ore and the balance of the fuel is utilized for reducing the iron and its combination with carbon. The charge in a typical furnace per ton of pig iron produced is about 1.7 tons of ore or other iron bearing materials, 0.5–0.65 tons of coke or other fuel, and about 0.25 tons of limestone and/or dolomite. Additionally, from 1.8–2.0 tons of air are blown through the furnace during the process.

As stated above, the coke is added to the furnace to produce the heat required for smelting and also to supply the chemical reactants, primarily carbon monoxide, to reduce the iron ore. In addition to this, the coke supplies the carbon that dissolves in the hot metal, generally from 70 to 80 pounds per ton of pig iron. As to the expense of the coke, serious considerations have been given to replacing this coke with other sources of fuel. When a liquid fuel or powdered coal is used to replace part of the coke, it is generally injected into the blast furnace tuyeres. Generally when these types of fuels are injected in this manner, the moisture content of hot air blast must be increased to control the flame temperature. These materials are generally fed into the air blast by a lance entering the air stream from the sides of the blow pipes, or, alternatively, it may be fed to the circle pipe and then to each tuyeres letting the combustion take place just inside the furnace.

Various methods have been proposed for dealing with this problem. In one, described in Offenlegungsschrift P 2,039,659 to Esso Research and Engineering Company, hereinafter incorporated by reference, a water-in-oil emulsion is formed containing 85–97% crude oil, residual oil, or fuel oil, 2–20% water, and may include a non-alkali metal emulsifier in quantities of from 0.1–0.3% by weight of the total emulsion. The water in this case serves to further atomize the liquid fuel when injected into the furnace apparently causing more complete combustion from the smaller liquid fuel particles. By the use of this method, the proportional quantity of liquid fuel over coke has been increased to some extent without causing the occurence of undesirable soot formation with the further added advantage that unsuitable crude oils can be put to use without additional technical or equipment expenditures. While this method has been an improvement to the art, other methods have also been employed.

One of these methods include the homogenization of liquid fuel-water mixtures and the injection of the resultant emulsion formed into the blast furnace under pressure. This method is described in a paper entitled, "Homogenized Oil Injection at Dofasco," by J. D. Ashton and J. E. R. Holditch, in a paper presented at the 34th Ironmaking Conference in Toronto, Ontario, Canada on Apr. 14, 1975. While homogenization helped to eliminate soot formation and increase the amount of liquid fuel that may be fed to the furnace, again, only so much coke could be replaced by a liquid fuel. It appears that carbon black or soot is the main limiting factor as to the amount of liquid fuel that can be injected per net ton of hot metal into the furnace.

When adding liquid fuel, it is of critical importance to achieve complete gasification as otherwise soot is formed. Thus, the amount of oil is dependent upon the point at which the formation of soot occurs. As is known, soot is detrimental to a successful blast furnace operation for various reasons. The limit for a satisfactory gasification of oil at a blast temperature of 1,000° C. lies at 165 to 177 pounds of oil per one ton of pig iron. An increase in the amount of oil without causing soot formation, with the concomitant decrease of coke consumption, requires a more rapid gasification of the oil which can be accomplished by higher tuyere gas temperatures, on the one hand, and smaller droplets, on the other hand. An increase in the tuyere gas temperature requires maximum hot air heating or the addition of oxygen.

As discussed earlier, the prior art has shown it advantageous to mix the liquid fuel with water to reduce soot formation by decreasing the particle size of the fuel droplets inside the furnace. This is generally believed to be caused by the many explosions of the water droplets in admixtures of this type when the emulsion hits the hot air blast. While this method has proven satisfactory, there is still a serious limitation as to the amount of oil or other liquid fuel that can be utilized to replace coke. Again, if the amount of soot produced as a by-product could be reduced in this process, it would be of great benefit to the art.

It is the subject of this invention to allow greater replacement ratios of substituted fuels:coke than heretofore has been obtained by the methods of the prior art. This invention finds great applicability to the homogenized process as described above and briefly includes the addition of low levels of a combustion catalyst to the water-in-oil emulsion. Additionally, a water-in-oil emulsifier may be incorporated into the system to further increase the efficiency of liquid fuel injection into blast furnace systems.

While materials of this type have been used prior to this invention in blast furnaces, to the best of applicant's knowledge they have not been fed to systems where the liquid fuel-water mixture is homogenized. The startling and surprising benefit of this invention fully shows itself only in those circumstances where homogenization is used.

OBJECTS

It is, therefore, an object of this invention to provide to the art a method for increasing the efficiency of liquid fuel addition in blast furnaces in which the liquid fuel is homogenized with water prior to introduction into the furnace.

A further object of this invention is to provide to the art a method for increasing the amount of liquid fuel which can be fed into a blast furnace to replace coke, where the liquid fuel is homogenized with from 2–20% by weight water and contains, in addition, a metallic combustion catalyst.

A still further object of this invention is to provide to the art a method for increasing the amount of coke that may be replaced by liquid fuel in blast furnaces where the liquid fuel is homogenized with from 2–20% by weight water and contains a metallic combustion catalyst and a water-in-oil emulsifying agent.

Further objects will appear hereinafter.

THE INVENTION

This invention encompasses an improved process for injecting a homogenized water-hydrocarbon liquid fuel composition into blast furnaces of the type wherein 2–20% by weight water and a liquid hydrocarbon fuel is homogenized and then atomized into a blast furnace under pressure to reduce coke consumption, the improvement which comprises introducing into the water-hydrocarbon liquid fuel composition prior to homogenization a metallic element in the form of a compound thereof, said metallic element being selected from the group consisting of magnesium, calcium, manganese, iron, cobalt, nickel, copper, zinc, aluminum, tin, lead, strontium, barium, zirconium, chromium, molybdenum, and tungsten in a quantity sufficient to provide 5–50 ppm as metal in the water-hydrocarbon liquid fuel composition whereby the efficiency of the blast furnace water-hydrocarbon liquid fuel injection is improved.

In addition, from 100–10,000 ppm of a water-in-oil emulsifying agent may be incorporated into the water-hydrocarbon liquid fuel composition.

THE METALLIC ELEMENT

The metallic elements previously mentioned are used in the practice of the invention in the form of a compound thereof. The metals specifically are selected from the group consisting of magnesium, calcium, strontium, barium, zirconium, chromium, molybdenum, tungsten, manganese, iron, cobalt, nickel, copper, zinc, aluminum, tin, and lead.

It is well known that metal compounds which contain the above identified metals all act as combustion catalysts or soot removers. Expressed in a different manner, these compounds when combined with a hydrocarbon fuel tend to reduce the ignition temperature of the soot formed by the combustion of the fuels, thereby allowing carbonaceous deposits to be burned and form primarily carbon dioxide. The metals may be used either alone or in combination with one another to form blended combustion catalysts. In a preferred practice of the invention, it is desired to use the above metals in oil soluble form. Compounds of this type are the fatty acid soaps of the metals. Such compounds are described in the following U.S. Pat. Nos. 2,141,848; 2,844,112; and 2,622,671.

In U.S. Pat. No. 2,622,671 are described certain fatty acids which may be described as branch chained acyclic aliphatic carboxylic acids of 5 to 12 carbon atoms, in which the carboxyl group is attached to a carbon atoms other than the central carbon atom in the longest hydrocarbon chain.

Acids whose salts fall within the scope of this invention, and have been shown to be suitable, include the following:

| | |
|---|---|
| 2-methylbutanoic | 2-ethyl-4-methylpentanoic |
| 3-methylbutanoic | 3-ethyl-4-methylpentanoic |
| 2-methylpentanoic | 2,2,3,3-tetramethylbutanoic |
| 4-methylpentanoic | 2-methyloctanoic |
| 2,3-dimethylbutanoic | 3-methyloctanoic |
| 3,3-dimethylbutanoic | 3-propylhexanoic |
| 2-methylhexanoic | 2-propyl-4-methylpentanoic |
| 4-methylhexanoic | 2,2-dimethylheptanoic |
| 5-methylhexanoic | 2-ethyl-5-methylhexanoic |
| 2-ethylpentanoic | 2-methylnonanoic |
| 2,4-dimethylpentanoic | 2,7-dimethyloctanoic |
| 3,3-dimethylpentanoic | 2-ethyloctanoic |
| 3-ethylpentanoic | 4-ethyloctanoic |
| 2,2-dimethylpentanoic | 2-propylheptanoic |
| 2-ethyl-3-methylbutanoic | 2-propyl-5-methylhexanoic |
| 6-methylheptanoic | |
| 2-ethylhexanoic | |
| 2,5-dimethylhexanoic | |
| 3,5-dimethylhexanoic | |
| 2,2-dimethylhexanoic | |

In addition to using metal salts to render the metallic compounds oil soluble, certain complexes of these metals which are oil soluble may also be employed. Examples of such materials are described in U.S. Pat. No. 2,591,503.

The preferred metals of the above grouping are copper and cobalt with copper being the most preferred. Other type complexes that may be used are described in U.S. Pat. No. 2,338,578.

Since the metallic compounds of the subject invention are being used in a system containing both a hydrocarbon fuel and water, the metallic element may also be in the form of a water-soluble salt. Examples of suitable salts of these materials include the chlorides, sulfates, nitrates, carbonates, acetates, and phosphates among others. Due to the corrosive nature of some of the anions, the acetates, phosphates, etc., are the preferred water-soluble salts. As will be seen, the choice of anion will be dictated by the properties of that particular metallic salt combination since ideally the combination will be readily soluble in water. The preferred water-soluble compounds are copper or cobalt chlorides or sulfates, although, as it will be seen, other materials and other anions may be used. When these materials are employed, they are generally added at the same level as the hydrocarbon soluble metallic salts discussed above generally at a level of from 5–50 ppm as the metal in the water-hydrocarbon liquid fuel composition.

EMULSIFYING AGENTS

The emulsifiers used as the subject of this invention and in conjunction with the combustion catalyst are capable of forming water-in-oil emulsions and may be cationic, anionic, non-ionic, or mixtures thereof. Preferred materials are petroleum sulfonates such as those described in U.S. Pat. No. 2,904,415 hereinafter incorporated by reference. These materials are commercially available and generally have a molecular weight of 400 or more. Another class of surfactants useful are mahogany acid salts which are oil soluble, as well as alkyl aryl sulfonates such as sulfonated alkyl benzine which are also particularly effective when used in the practice of this invention. Other emulsifying materials useful include ethyleneoxide condensate with alkyl phenols and ammonium salts of monoethylphenyl sulfonic acids.

Other surfactants that find usefulness in this invention include fatty acids containing 10–24 carbon atoms and alkaline earth salts thereof. It should be pointed out that alkali metals should be avoided for blast furnace use since the alkali metal accumulates in the upper part of the furnace and leads to the formation of alkali metal cyanides and other undesirable materials.

Other surfactants or emulsifying agents useful include water-in-oil emulsifying agents such as sorbitan monostearate, sorbitan monooleate, and the so called low HLB materials which are all documented in the literature and the Atlas HLB Selector. Although the mentioned emulsifiers are useful, other water-in-oil emulsifiers may be used so long as they are comparable of producing these emulsions. In the selection of a suitable emulsifier, it is important to take into account variations in the liquid fuel being emulsified and the quality of an emulsion produced with a typical surfactant. As a result, variations may occur which dictate that the emulsifiers should be tried on a case by case method.

The emulsifier, which is an optional ingredient in the composition of this invention, is generally used at a level of from 100–10,000 ppm by weight of the liquid hydrocarbon fuel-water composition. As will be seen, this amount can be varied based on the liquid fuel being utilized and the possibility that the liquid fuel may already contain certain surface active agents which will serve the purpose of this invention. The function of the emulsifying agent of this invention is believed to enable the formation of much smaller droplets in the homogenization process and to maintain the stability of the homogenized water-liquid hydrocarbon fuel composition from the time it is prepared to the time that it is injected or atomized into the blast furnace.

In the typical utilization of materials of this invention, the metallic element is added either to the water or to the liquid hydrocarbon fuel to be employed prior to its mixing with the other component. Alternatively, of course, the mixture may be fed to the combined stream of the water and liquid fuel prior to homogenization. All that is important is that the metallic element and optional surfactant be present and be intimately admixed with the water-liquid fuel mixture prior to its introduction into the blast furnace. When the metallic element is employed in an oil or hydrocarbon soluble form, it will oftentimes be advantageous to prepare a mixture of this material in a non-viscous hydrocarbon solvent to ease the handling of the material to allow satisfactory measurement of the quantity being introduced. As a result, organic solvents of dimethylformamide or chlorinated hydrocarbons as well as N-alkanes may be used to prepare a solution of the metallic element compound. Oftentimes, the metallic element compound can be dissolved in the liquid fuel which is to be fed to the blast furnace. When the metallic element is in the form of a water-soluble salt, it will, likewise, be advantageous to prepare a dilute aqueous solution of this material which can be fed to the water line for ease of measurement and proportioning. Since the surfactants or emulsifiers selected for use in this invention are generally soluble in the liquid hydrocarbon fuel employed, these materials will often be either admixed with the metallic element compound when it is soluble in the hydrocarbon liquid or can be fed separately into the hydrocarbon liquid employed when a water-soluble metallic compound is utilized. The methods for injecting these materials into the stream and the preparation of the water-liquid hydrocarbon fuel composition are well known in the art, and those skilled will readily appreciate the necessary methods to be followed and the equipment to be utilized. The homogenized material, under pressure, generally had its pressure raised to a greater level during the homogenization step which is then lowered to approximately 200 psi, before discharge into the bottom of the blast furnace where the emulsion is effectively atomized due to the shattering effect of the high-velocity hot air blast as it hits the slow moving emulsion stream. Secondly, atomization within occurs as the hot air blast mixes with the emulsion droplets to generate a series of micro explosions as the water rapidly expands to steam. The net result is a high-temperature mixture of liquid hydrocarbon fuel micro droplets, steam, and air. The liquid hydrocarbon fuel micro droplets are then evaporated to produce flammable vapor which is mixed with the hot air blast followed by ignition and progressive combustion of the liquid fuel vapor and subsequent heat transfer to the liquid fuel micro droplets discussed above by conduction from the flame front.

THE LIQUID HYDROCARBON FUELS

The oils or liquid fuels used in the subject of this invention may be any kind of distillation by-product or residue from petroleum refining operations having viscosities of 2.5 to 26,500 centistokes. Included in the liquid fuel useful in this invention are coke oven tars, crude oil, heavy fuel oil, such as "bunker 'C'" as well as other fuel oils. The preferred method of applying the oil emulsion is to prepare the oil-water mixture containing the desired percentage of water depending on the moisture content of the hot air blast, and subjecting this material containing the composition of this invention to the pumping section of a homogenizer. In the homogenizer, the oil-water mixture is increased from a pressure of approximately 200 psi to approximately 2,000 psi. In the homogenizer, the material is mixed and is discharged at an approximate pressure of 200 psi into the furnace. In a typical oil-in-water emulsion, which this invention is concerned with, water content is about 5–15% and maximum water droplet size varies from 5–10 microns. The droplets of the oil in the stream injected into the furnace average generally from between 2–10 microns. Oftentimes, when using a heavy oil such as crude oil or residual fuels, it will be advantageous to heat the fuel to a temperature at which it becomes substantially fluid in order to prepare the most satisfactory water-in-oil emulsions. By the use of systems of this type including the combustion catalyst (metallic element) and emulsifiers of this invention, carbon black formation or soot is cut down. By cutting down or eliminating carbon black or soot formation the coke replacement ratio is improved, furnace productivity may be increased and iron quality is maintained at a high level.

In order to more fully illustrate this invention, the following examples are presented:

EXAMPLE I

The composition was prepared containing 50% by weight of a 12% solution of copper octoate, 5% by weight dimethylformamide, 5% by weight of a fuel oil having a flash point of between 150 to 185° F. and SUS viscosity of 100° F. between 33.6 and 35.9 minutes. In addition, the composition contained 20% by weight of a chlorinated hydrocarbon having an average chemical formula of $C_{22}H_{40}Cl_6$, and having a specific gravity of between 1.175 and 1.210 at 25° C. The composition also contained 20% by weight of an anionic sulfonated petroleum derivative having a molecular weight of 415–425, available commercially from the Witco Chemical Corporation. The oil was used in this case to insure the ease of blending the mixture into the fuel oil being utilized.

EXAMPLE II

A steel mill operating a blast furnace at a normal oil injection rate of 220–230 pounds of oil per net ton of hot metal utilized the above composition in a homogenized water-in-oil emulsion of a Bunker 'C' fuel oil containing approximately 5% water. With the addition of 250 ppm of the composition of the instant invention shown in Example I, the oil rate was increased to a level of from 250 to 260 pounds of oil per net ton of hot hetal. This resulted in a savings of coke of approximately 30 lbs. per net ton of hot metal. No soot formation was noted at the oil injection rate being used.

It should be noted that prior to the introduction of the composition of this invention into the blast furnace, it has been thought that the maximum amount of oil injected per ton of hot metal produced had been met. No other parameters were changed when the composition was added.

EXAMPLE III

In another furnace utilizing homogenized injection of a water-in-oil emulsion of Bunker 'C' oil containing approximately 6% by weight water treated with approximately 250 ppm of the composition described in Example I, the oil rate was increased to 300 pounds of oil with an equivalent coke replacement. This was considered to be 30 to 35% higher than the rate of homogenized fuel and water injection possible without the addition of the composition described in Example I. No soot problems associated with this type of water-in-oil fuel emulsion injection were noted as would normally be the case in the increased fuel rate in furnaces of this type. It is also possible that furnace capacity may be increased by allowing for additional feed of burden to replace a portion of the furnace volume vacated by the reduction of coke.

I claim:

1. An improved process for injecting a homogenized water-hydrocarbon liquid fuel composition into blast furnaces of the type wherein water and a liquid hydrocarbon fuel are homogenized and then atomized into a blast furnace under pressure to reduce coke consumption, the improvement which comprises introducing into the water-hydrocarbon liquid fuel composition prior to homogenization a metallic element in the form of a compound thereof, said metallic element being selected from the group consisting of zirconium, chromium, molybdenum, tungsten, manganese, iron, cobalt, nickel, copper, zinc, aluminum, tin and lead in a quantity sufficient to provide 5–50 ppm as metal in the water-hydrocarbon liquid fuel composition whereby the efficiency of the blast furnace water-hydrocarbon liquid fuel injection is improved.

2. The improved process of claim 1 where the metallic element is copper.

3. The improved process of claim 2 where the copper is in the form of an oil-soluble compound of copper.

4. The method of claim 3 wherein the copper compound is an oil-soluble copper salt of a branch chained fatty acid containing at least 5 carbon atoms.

5. The improved process of claim 1 wherein the water-hydrocarbon fuel composition contains 2–20% by weight of water.

6. An improved process for injecting a homogenized water-hydrocarbon liquid fuel composition into blast furnaces of the type wherein water and a liquid hydrocarbon fuel are homogenized and then atomized into a blast furnace under pressure to reduce coke consumption, the improvement which comprises introducing into the water-hydrocarbon liquid fuel composition prior to homogenization a metallic element being selected from the group consisting of zirconium, chromium, molybdenum, tungsten, manganese, iron, cobalt, nickel, copper, zinc, aluminum, tin and lead in a quantity sufficient to provide 5–50 ppm as metal and from 100–10,000 ppm of a water-in-oil emulsifying agent in the water-hydrocarbon liquid fuel composition whereby the efficiency of the blast furnace water liquid fuel injection is improved.

7. The improved process of claim 6 where the metallic element is copper.

8. The improved process of claim 7 where the copper is in the form of an oil-soluble compound of copper.

9. The method of claim 8 wherein the copper compound is an oil-soluble copper salt of a branch chained fatty acid containing at least 5 carbon atoms.

10. The improved process of claim 6 wherein the water-hydrocarbon fuel composition contains 2–20% by weight of water.

11. The improved process of claim 6 wherein the water-in-oil emulsifying agent is an anionic surfactant.

12. The improved process of claim 11 wherein the anionic surfactant is a sulfonated anionic surfactant.

* * * * *